US008036818B2

(12) United States Patent
Kasai et al.

(10) Patent No.: US 8,036,818 B2
(45) Date of Patent: Oct. 11, 2011

(54) CONTROL APPARATUS FOR GENERAL-PURPOSE ENGINE

(75) Inventors: Akihito Kasai, Saitama (JP); Hideaki Shimamura, Wako (JP); Tomoki Fukushima, Saitama (JP); Makoto Yamamura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 418 days.

(21) Appl. No.: 12/383,151

(22) Filed: Mar. 20, 2009

(65) Prior Publication Data

US 2009/0271097 A1 Oct. 29, 2009

(30) Foreign Application Priority Data

Apr. 25, 2008 (JP) ..... 2008-115607
Apr. 25, 2008 (JP) ..... 2008-115608
Apr. 25, 2008 (JP) ..... 2008-115609

(51) Int. Cl.
*F02D 41/00* (2006.01)
*F02M 51/00* (2006.01)

(52) U.S. Cl. ..... 701/113; 701/103; 123/399

(58) Field of Classification Search ..... 701/113, 701/112, 102, 115; 123/179.16, 179.18, 123/491, 361, 399
See application file for complete search history.

(56) References Cited

U.S. PATENT DOCUMENTS 4,440,119 A * 4/1984 Kobayashi et al. ..... 123/492
5,537,964 A 7/1996 Hoshiba
2010/0269787 A1* 10/2010 Shimamura et al. ..... 123/362

FOREIGN PATENT DOCUMENTS

JP 5-059992 A 3/1993
JP 7-077106 A 3/1995

* cited by examiner

*Primary Examiner* — Hieu T Vo
(74) *Attorney, Agent, or Firm* — Carrier Blackman & Associates, P.C.; Joseph P. Carrier; William D. Blackman

(57) ABSTRACT

In a general-purpose engine having a throttle valve installed in an air intake passage connected to a combustion chamber, sucked air mixing with fuel to generate an air-fuel mixture to be ignited to drive a piston to rotate a crankshaft connected to a load, a first warm-up time period during which the engine is warmed up and a second warm-up time period which is longer than the first time period are determined based on detected engine temperature and a fuel quantity is increased during the first time period. The operation of the motor is controlled such that a change rate of throttle valve opening is limited within a range until the measured time exceeds the second warm-up time period after it exceeded the first time period. With this, it becomes possible to complete warm-up operation in a short period of time, while improving rate of fuel consumption and emission performance.

24 Claims, 13 Drawing Sheets

CONTROL APPARATUS FOR GENERAL-PURPOSE ENGINE

BACKGROUND OF THE INVENTION

1. Field of the Invention

This invention relates to a control apparatus for a general-purpose internal combustion engine, particularly to an apparatus for controlling warm-up operation of a general-purpose internal combustion engine.

2. Description of the Related Art

Conventionally, in general-purpose internal combustion engines used as prime movers in generators, agricultural machines and various other equipment conducting engine, warm-up operation is conducted since engine starting for making the engine speed stable to prevent engine stall due to abrupt opening and closing of a throttle valve as taught by Japanese Laid-Open Patent Application No. Hei 5(1993)-59992 (paragraphs 0035, 0036, 0042 to 0044, FIGS. 10, 15, etc.).

However, when a fuel quantity is kept increasing until the engine has been completely warmed up as described in the reference '992, although engine stall can be surely prevented, the rate of fuel consumption and also the emission performance degrades disadvantageously. Therefore, it is preferable to complete the warm-up operation with increased fuel in a short period of time.

It is also known to start the engine warm-up operation by closing a choke valve to a position corresponding to ambient temperature for increasing fuel quantity and to finish it by gradually opening the choke valve to a fully-opened position as taught by Japanese Laid-Open Patent Application No. Hei 7(1995)-77106 (paragraphs 0036, 0041 to 0044, FIGS. 3, 4, etc.).

However, since an appropriate or optimal time period of warm-up differs depending on ambient temperature or condition of the engine, if the warm-up operation is conducted by regulating the choke valve position based solely on the ambient temperature, i.e., by determining the warm-up time period based solely on the ambient temperature as disclosed in the reference '106, the warm-up time period could be inappropriate depending on the condition of the engine. This also leads to the degradation of the rate of fuel consumption and occurrence of engine stall.

SUMMARY OF THE INVENTION

A first object of this invention is therefore to overcome the problem by providing a control apparatus for a general-purpose engine that can complete warm-up operation with increased fuel quantity in a short period of time to prevent a stall at engine starting, while improving rate of fuel consumption and emission performance.

A second object of this invention is to overcome the problem by providing a control apparatus for a general-purpose engine that can appropriately determine a warm-up time period of the engine to improve the rate of fuel consumption and emission performance, while preventing an engine stall.

In order to achieve the first objects, this invention provides an apparatus for (and a method of) controlling a general-purpose internal combustion engine having a throttle valve installed in an air intake passage connected to a combustion chamber, air sucked in flowing through the air intake passage and mixing with fuel to generate an air-fuel mixture that enters the combustion chamber of a cylinder and ignited to drive a piston to rotate a crankshaft to be connected to a load, comprising: an actuator for opening/closing the throttle valve; a temperature detector that detects a temperature of the engine; a warm-up time period determiner that determines a first warm-up time period during which the engine is to be warmed up and a second warm-up time period which is longer than the first warm-up time period, based on the detected engine temperature; a timer that measures an elapsed time period since starting of the engine; a fuel quantity increaser that increases a fuel quantity to be supplied to the engine until the measured time exceeds the first warm-up time period; and a controller that controls operation of the actuator such that a change rate of throttle opening of the throttle valve is limited within a range until the measured time period exceeds the second warm-up time period after the measured time period exceeded the first warm-up time period.

In order to achieve the second objects, this invention provides an apparatus for (and a method of) controlling a general-purpose internal combustion engine having a throttle valve installed in an air intake passage connected to a combustion chamber, air sucked in flowing through the air intake passage and mixing with fuel to generate an air-fuel mixture that enters the combustion chamber of a cylinder and ignited to drive a piston to rotate a crankshaft to be connected to a load, comprising: a temperature detector that detects a temperature of the engine; an ambient temperature detector that detects an ambient temperature; a warm-up time period determiner that determines a warm-up time period based on the detected engine temperature and the detected ambient temperature; a timer that measures an elapsed time period since starting of the engine; and a fuel quantity increaser that increases a fuel quantity to be supplied to the engine until the measured time period exceeds the warm-up time period.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

A control apparatus for a general-purpose engine according to preferred embodiments of the present invention will now be explained with reference to the attached drawings.

Figure 1:
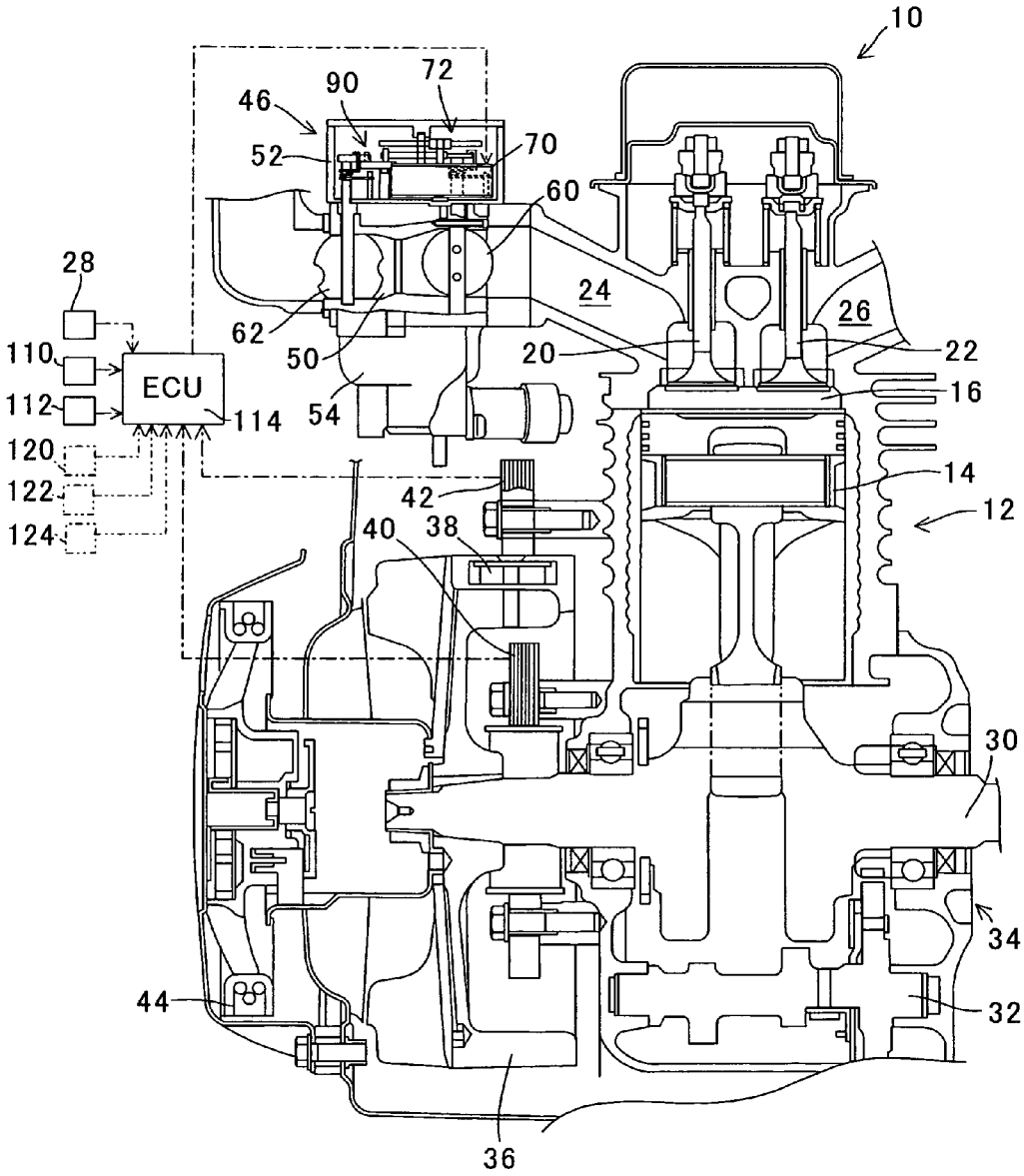
FIG. 1 is an overall view of a control apparatus for a general-purpose engine according to a first embodiment of this invention.

FIG. 1 is an overall view of a control apparatus for a general-purpose engine according to a first embodiment of this invention.

Reference numeral 10 in FIG. 1 designates a general-purpose internal combustion engine (hereinafter simply called "engine"). The engine 10 is an air-cooled, four-cycle, single-cylinder OHV model with a displacement of, for example, 440 cc. The engine 10 is suitable for use as the prime mover of a generator, agricultural machine or any of various other kinds of equipment.

The engine 10 has a cylinder 12 accommodating a piston 14 that can. reciprocate therein. An intake valve 20 and exhaust valve 22 are installed so as to face a combustion chamber 16 of the engine 10 for opening and closing communication between the combustion chamber 16 and an intake port 24 or exhaust port 26. A temperature sensor 28 is disposed near the cylinder 12 for producing an output indicating the temperature of the engine 10.

The piston 14 is connected to a crankshaft 30 that is connected to a camshaft 32. The crankshaft 30 and camshaft 32 are housed in a crank case 34 attached to the bottom of the cylinder 12. The lower portion of the crank case 34 constitutes an oil pan for receiving oil (lubricant oil).

One end of the crankshaft 30 is connected with a load (not shown) such as a generator and the other end thereof with a flywheel 36. The flywheel 36 is installed with magnet pieces 38 on its inside surface. On the inside of the flywheel 36, a power coil (generation coil) 40 is fastened to the engine body to face the magnet pieces 38 and on the outside thereof, a pulsar coil 42 is also fastened to the engine body to face the magnet pieces 38. The power coil 40 produces alternating current whose frequency corresponds to rotational speed of the crankshaft 30 and the pulsar coil 42 produces a pulse signal at every predetermined crank angle. The crankshaft 30 is attached with a recoil starter 44 that starts the engine 10 when manually manipulated or operated by the operator.

A carburetor 46 is connected to the intake port 24.

Figure 2:
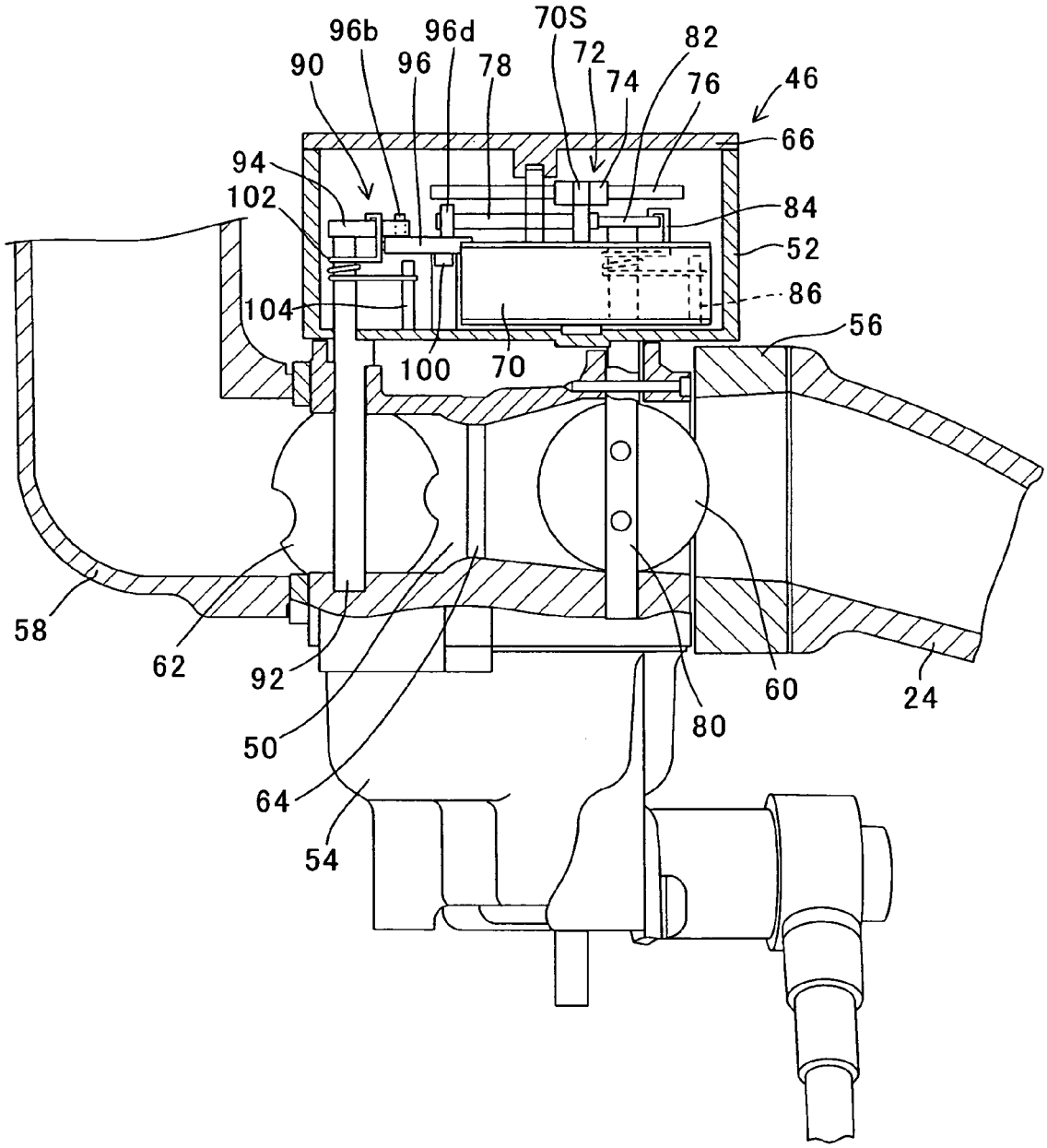
FIG. 2 is an enlarged cross-sectional view of a carburetor shown in FIG. 1.

FIG. 2 is an enlarged cross-sectional view of the carburetor 46 shown in FIG. 1.

As shown in FIG. 2, the carburetor 46 unitarily comprises an air intake passage 50, motor case 52 and carburetor assembly 54. The downstream side of the air intake passage 50 is connected through an insulator 56 to the intake port 24, and the upstream side thereof is connected through an air-cleaner elbow 58 to an air-cleaner (not shown). A throttle valve 60 is installed in the air intake passage 50 and a choke valve 62 is also installed in the air intake passage 50 on the upstream side of the throttle valve 60. The air intake passage 50 is reduced in diameter between the throttle valve 60 and choke valve 62 to form a venturi 64.

The motor case 52 is attached with a cover 66 and the internal space formed by the motor case 52 and cover 66 is disposed with an electric motor (actuator) 70 that moves the throttle valve 60 and choke valve 62. Specifically, the motor 70 is a stepper motor having a rotor and a stator wound with a coil and connected to the throttle valve 60 via a throttle valve opening/closing mechanism (gear mechanism) 72.

Figure 3:
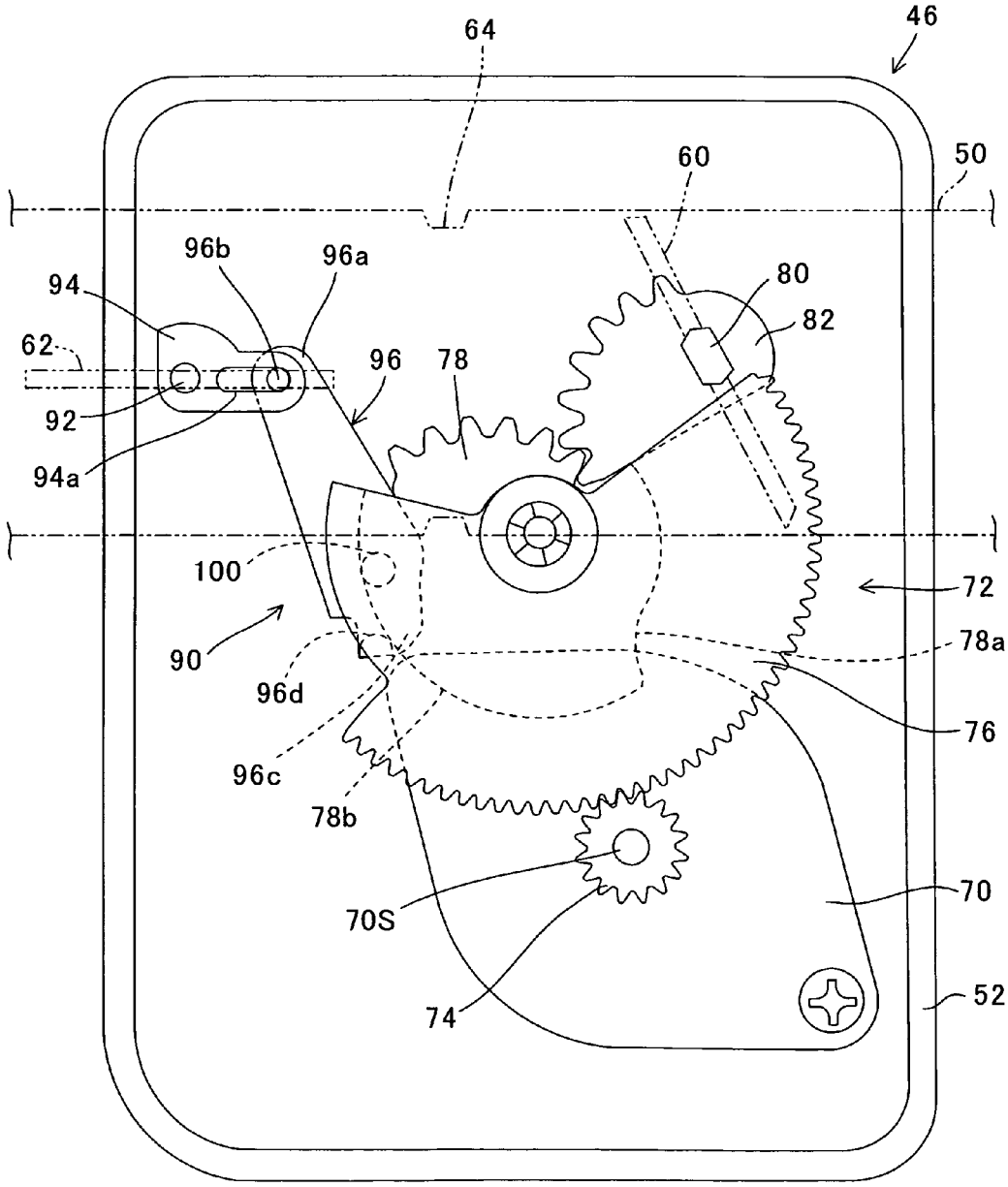
FIG. 3 is a plan view of the carburetor shown in FIG. 2 when a cover of a motor case is removed.

FIG. 3 is a plan view of the carburetor 46 shown in FIG. 2 when the cover 66 of the motor case 52 is removed. FIG. 3 shows the status where the throttle valve 60 is at the fully-closed position and the choke valve 62 is at the fully-opened position, as indicated by imaginary lines.

As shown in FIGS. 2 and 3, the mechanism 72 includes four gears. Specifically, an output shaft 70S of the motor 70 is attached with a first gear 74 and the first gear 74 is engaged with a second gear 76 which is rotatably supported in the motor case 52. A third gear (eccentric gear) 78 is installed coaxially with the second gear 76 to be integrally rotatable therewith. As can be seen in FIG. 3, the third gear 78 is formed with teeth only on a part of its circumference (where a fourth gear (explained later) is to be engaged).

The third gear 78 is engaged with the fourth gear (eccentric gear; now assigned by 82) attached to a throttle shaft 80 that supports the throttle valve 60. With this configuration, the output of the motor 70 is reduced in speed in accordance with gear ratios of the gears 74, 76, 78, 82 and transmitted to the throttle shaft 80 to open and close the throttle valve 60. One of the characteristics of this embodiment is that the mechanism 72 is configured to open and close the throttle valve 60 within a range between the fully-closed position and a position over or beyond the fully-opened position by predetermined opening, i.e., a position set over the fully-opened position in the opening direction by predetermined opening, in response to the operation of the motor 70. This will be explained later.

The throttle shaft 80 is installed on its circumference with a return spring 84 (shown in FIG. 2) that is constituted of a torsion coil spring. One end of the return spring 84 is connected to the fourth gear 82 and the other end thereof is connected to a hook pin 86 (shown in FIG. 2) that projects in the motor case 52. Winding of the return spring 84 is set in the direction in which the throttle valve 60 is opened via the throttle shaft 80.

The mechanism 72 is connected with the choke valve 62 through a choke valve opening/closing mechanism 90. The mechanism 90 comprises an arm 94 that is attached to a choke shaft 92 supporting the choke valve 62 for rotating the shaft 92, and a link 96 that connects the arm 94 with the mechanism 72 (precisely, the third gear 78 thereof).

The link 96 is supported to be rotatable about a rotation shaft 100 in the motor case 52. The link 96 is provided at its end (one end) 96*a* on the arm 94 side with a first pin 96*b* that extends upward in FIG. 2. The first pin 96*b* is inserted through a long hole 94*a* bored in the arm 94.

The link 96 is also provided at its end (the other end) 96*c* on the third gear 78 side with a second pin 96*d* that extends upward in FIG. 2. The second pin 96*d* abuts on the circumference of the third gear 78 at a portion not formed with teeth. The portion of the circumference of the third gear 78 where no teeth is formed (i.e., where the second pin 96*d* abuts) has a substantially disk shape and has a concavity. The portion of the circumference of the third gear 78 where the concavity is formed is called the "first abutment portion" and assigned by 78*a*. The remaining portion of the circumference of the third gear 78 where no teeth is formed other than the first abutment portion 78*a* is called the "second abutment portion" and assigned by 78*b*. Positions formed with the first and second abutment portions 78*a*, 78*b* on the circumference of the third gear 78 will be described later.

As shown in FIG. 2, a return spring 102 constituted of a torsion coil spring is installed on the circumference of the choke shaft 92. One end of the return spring 102 is connected to the arm 94 and the other end thereof to a hook pin 104 that projects in the motor case 52. Winding of the return spring 102 is set in the direction in which the choke valve 62 is closed via the choke shaft 92.

Since the choke valve opening/closing mechanism 90 is configured to include the return spring 102 that urges the choke valve 62 in the closing direction (toward the fully-closed position), the urging force is transmitted to the link 96 through the arm 94. As a result, counterclockwise force about the rotation shaft 100 acts on the link 96 so that the second pin 96*d* of the link 96 constantly abuts, as being pressed, on the circumference (i.e., the first or second abutment portion 78*a*, 78*b*) of the third gear 78.

The explanation of FIG. 1 will be resumed. The carburetor assembly 54 is connected to a fuel tank (not shown) to be supplied with fuel and produces air-fuel mixture by injecting fuel by an amount defined by the opening of the throttle valve 60. When the choke valve 62 is closed, the negative pressure in the air intake passage 50 generated by descending stroke of the piston 14 is increased, thereby increasing an amount of injected fuel and producing a rich air-fuel mixture.

The air-fuel mixture thus produced passes through the intake port 24 and intake valve 20 to be sucked into the combustion chamber 16. The air-fuel mixture in the combustion chamber 16 is ignited by a spark plug (not shown) to burn and the resulting combustion gas (exhaust gas) is discharged to the exterior of the engine 10 through the exhaust valve 22, exhaust port 26, a muffler (not shown) and the like.

An engine speed setting switch 110 and an engine stop switch 112 are installed to be manipulated by the operator. The switch 110 produces an output or signal indicative of desired engine speed NED in response to the manipulation by the operator. The switch 112 produces an ON signal when manipulated by the operator to input an instruction to stop the engine 10.

The outputs of the above-mentioned temperature sensor 28, power coil 40, pulsar coil 42, engine speed setting switch 110 and engine stop switch 112 are sent to an Electronic Control Unit (hereinafter referred to as "ECU") 114. The ECU 114 is constituted as a microcomputer having a CPU, ROM, RAM, input/output circuits and the like.

The output (alternating current) of the power coil 40 inputted to the ECU 114 is sent to a bridge circuit (not shown) in the ECU 114, where it is converted to direct current through full-wave rectification. The direct current is supplied as operating power to the components of the engine 10. The output of the power coil 40 is also sent to a pulse generation circuit (engine speed detection circuit; not shown) in the ECU 114, where it is converted to a pulse signal. Since the frequency of direct current generated by the power coil 40 is proportional to the rotational speed of the crankshaft 30, the engine speed NE can be detected based on the pulse signal obtained from the output of the power coil 40.

Based on the output (pulse signal) of the pulsar coil 42, the ECU 114 ignites the spark plug at ignition timing depending on the engine speed NE. Further, based on the outputs of the temperature sensor 28 and engine speed setting switch 110, the detected engine speed NE and the like, the ECU 114 determines desired openings of the throttle valve 60 and choke valve 62 and outputs control signals in accordance with the determined desired openings to a motor driver (not shown) so as to operate the motor 70, thereby opening and closing the valves 60, 62 to regulate the engine speed NE or fuel quantity to be supplied to the engine 10.

Next, the opening and closing operation of the throttle valve 60 and choke valve 62 will be explained with focus on the operation of the motor 70, throttle valve opening/closing mechanism 72 and choke valve opening/closing mechanism 90 with reference to FIGS. 3 and 4 onward.

FIG. 4 is an explanatory view showing the characteristics of the opening and closing operation of the throttle valve 60 and choke valve 62.

Figure 4A:
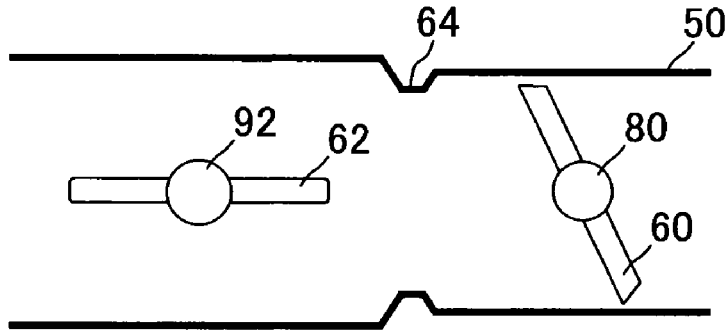
FIG. 4 is an explanatory view showing the characteristics of opening and closing operation of a throttle valve and choke valve shown in FIG. 1 etc.

In order to operate the throttle valve 60 to the fully-closed position, the motor 70 rotates the throttle shaft 80 through the first to fourth gears 74, 76, 78, 82 of the mechanism 72 so as to close the throttle valve 60 to the fully-closed position shown in FIGS. 3 and 4A. As can be seen in FIG. 3, at this time, the second pin 96*d* of the link 96 abuts on the second abutment portion 78*b* of the third gear 78 and the choke valve 62 is fully opened.

Figure 4B:
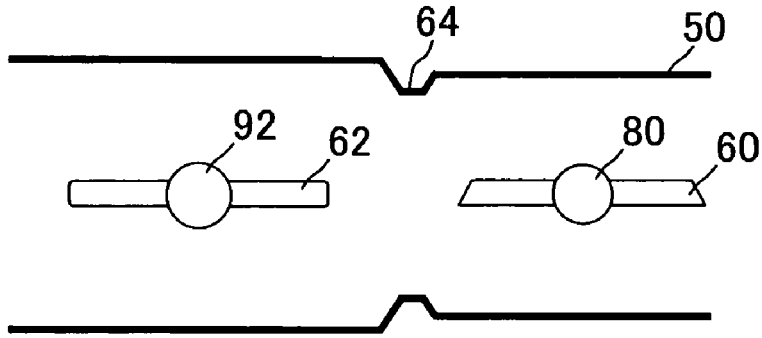
Figure 5:
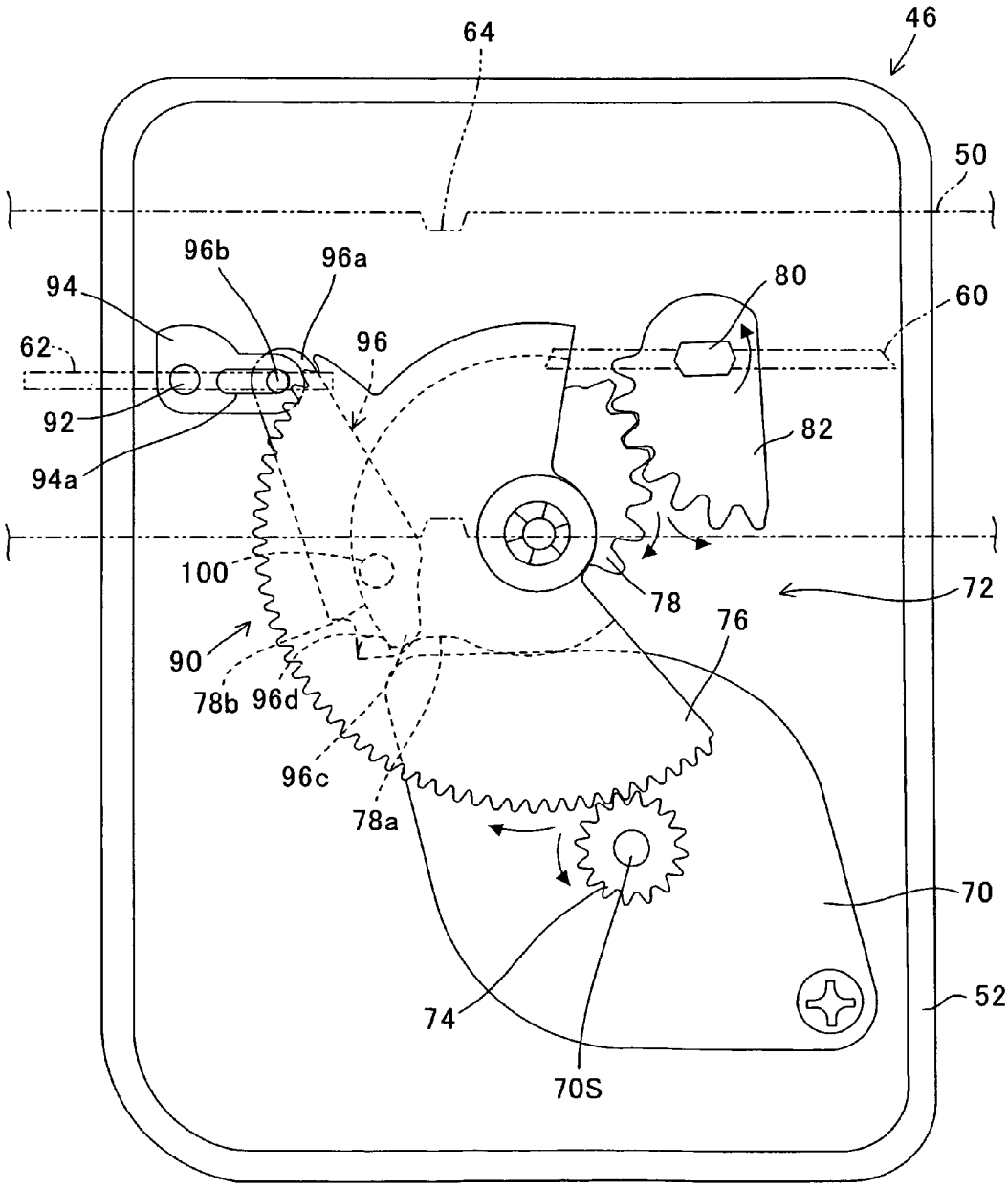
FIG. 5 is a view, similar to FIG. 3, showing the carburetor shown in FIG. 2.

In order to operate the throttle valve 60 from the fully-closed position to the fully-opened position, the motor 70 operates the first to fourth gears 74, 76, 78, 82 to rotate in the directions indicated by arrows in FIG. 5 to rotate the throttle shaft 80 counterclockwise, thereby opening the throttle valve 60 to the fully-opened position. At this time, since the second pin 96*d*, while sliding to a position near the first abutment portion 78*a*, remains abutting on the second abutment portion 78*b*, as can be seen in FIG. 4B, the choke valve 62 is held at the fully-opened position. Thus, when the throttle valve 60 is positioned between the fully-closed position and the fully-opened position, the mechanism 90 holds the choke valve 62 at the fully-opened position.

When the choke valve 62 is closed for producing the rich air-fuel mixture at engine starting (i.e., at warm-up of the engine; explained later) or the like, the motor 70 operates the mechanism 72 to displace the link 96 which moves in response thereto and rotate the choke shaft 92, thereby opening and closing the choke valve 62. Specifically, the motor 70 operates the first to fourth gears 74, 76, 78, 82 to rotate in the directions indicated by arrows in FIG. 6 to further rotate the throttle shaft 80 counterclockwise, thereby opening the throttle valve 60 to a position over or beyond the fully-opened position by predetermined opening $\alpha$, which position is hereinafter called the "over-fully-opened position."

At this time, the second pin 96*d* slides to the first abutment portion 78*a* by the rotation of the third gear 78. It causes the link 96 to displace or rotate about the rotation shaft 100 in the counterclockwise direction, so that the first pin 96*b*, while sliding in the long hole 94*a*, displaces the arm 94. The displacement of the arm 94 makes the choke shaft 92 rotate clockwise in the drawing, thereby closing the choke valve 62 to the fully-closed position as shown in FIG. 4C.

Figure 6:
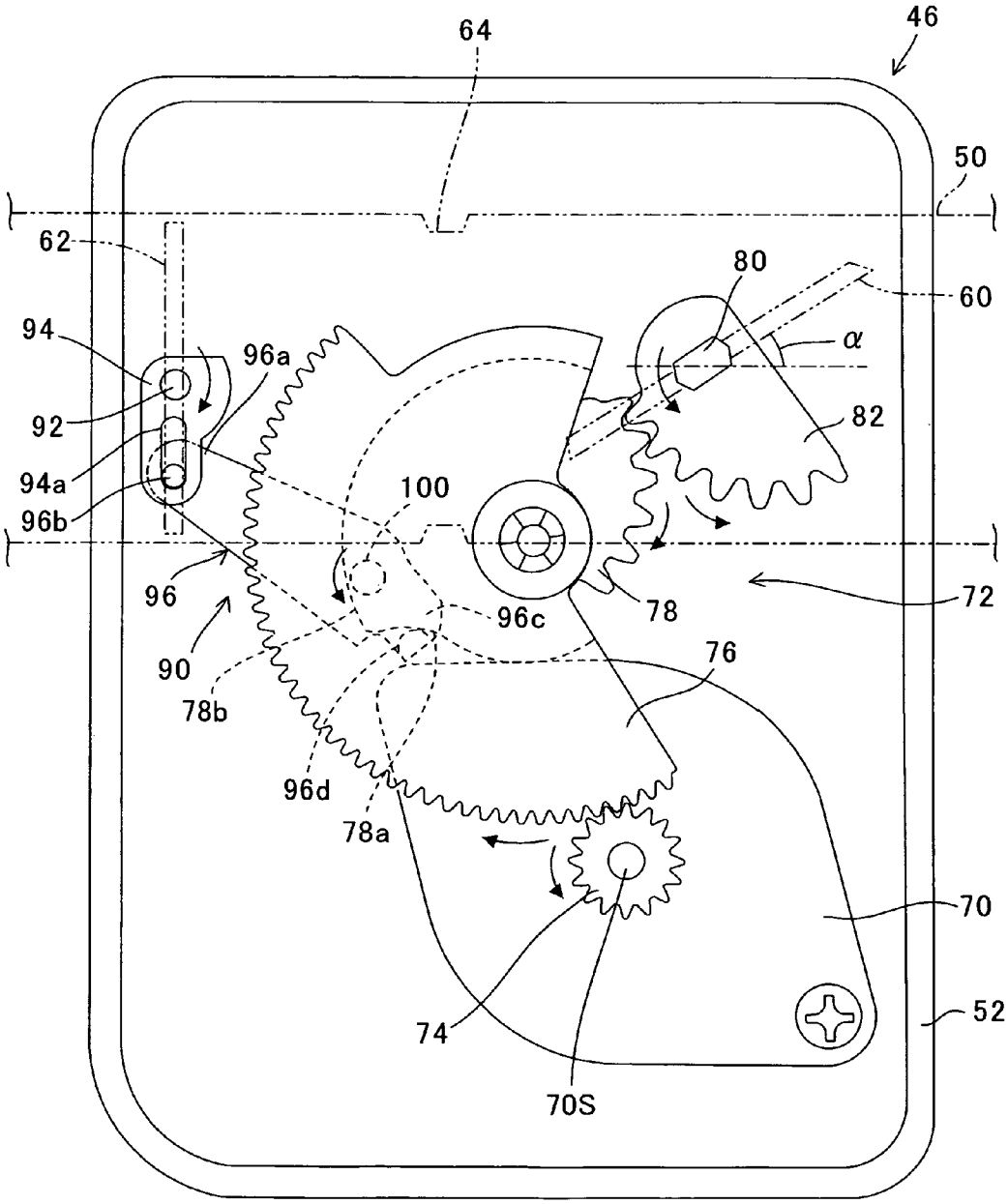
FIG. 6 is a view, similar to FIG. 3, showing the carburetor shown in FIG. 2.

Thus, the locations in the third gear 78 formed with the first and second abutment portions 78*a*, 78*b* are determined such that, when the second pin 96*d* abuts on the second abutment portion 78*b* as shown, for example, in FIGS. 3 and 5, the choke valve 62 is positioned at the fully-opened position, while the third gear 78 is rotated clockwise in the drawing by the motor 70, and when the second pin 96*d* abuts on the first abutment portion 78*a* (as shown in FIG. 6, for example), the choke valve 62 is positioned at the fully-closed position.

Figure 4C:
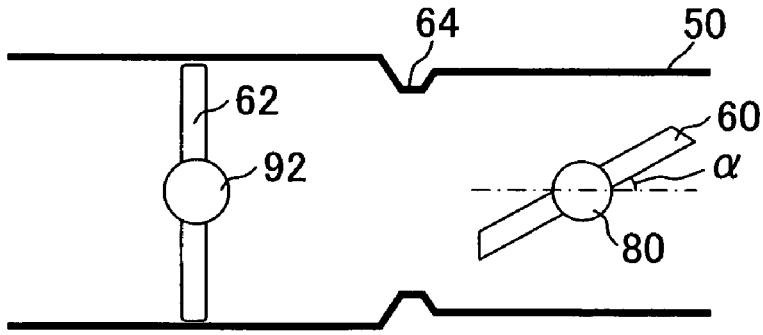

As shown in FIGS. 4A to 4C, the choke valve opening/closing mechanism 90 opens and closes the choke valve 62 in response to the movement of the throttle valve opening/closing mechanism 72. More specifically, when the throttle valve 60 is positioned between the fully-closed position and the fully-opened position, the mechanism 90 holds the choke valve 62 at the fully-opened position, and when the throttle valve 60 is positioned between the fully-opened position and the over-fully-opened position, it opens and closes the choke valve 62 within a range between the fully-opened position and the fully-closed position.

In the foregoing, the movement of the choke valve 62 is explained using two kinds of positions, i.e., the fully-opened position and the fully-closed position. Since the first abutment portion 78*a* is formed in the concave shape, the choke valve 62 can be regulated to achieve a given opening by appropriately regulating a position where the second pin 96*d* abuts on the first abutment portion 78*a*. In other words, the choke valve 62 can be opened and closed between the fully-opened position and the fully-closed position by properly regulating the opening of the throttle valve 60 between the fully-opened position and the over-fully-opened position.

Next, the explanation will be made on the opening and closing operation of the throttle valve 60 and choke valve 62 at engine starting.

Figure 7:
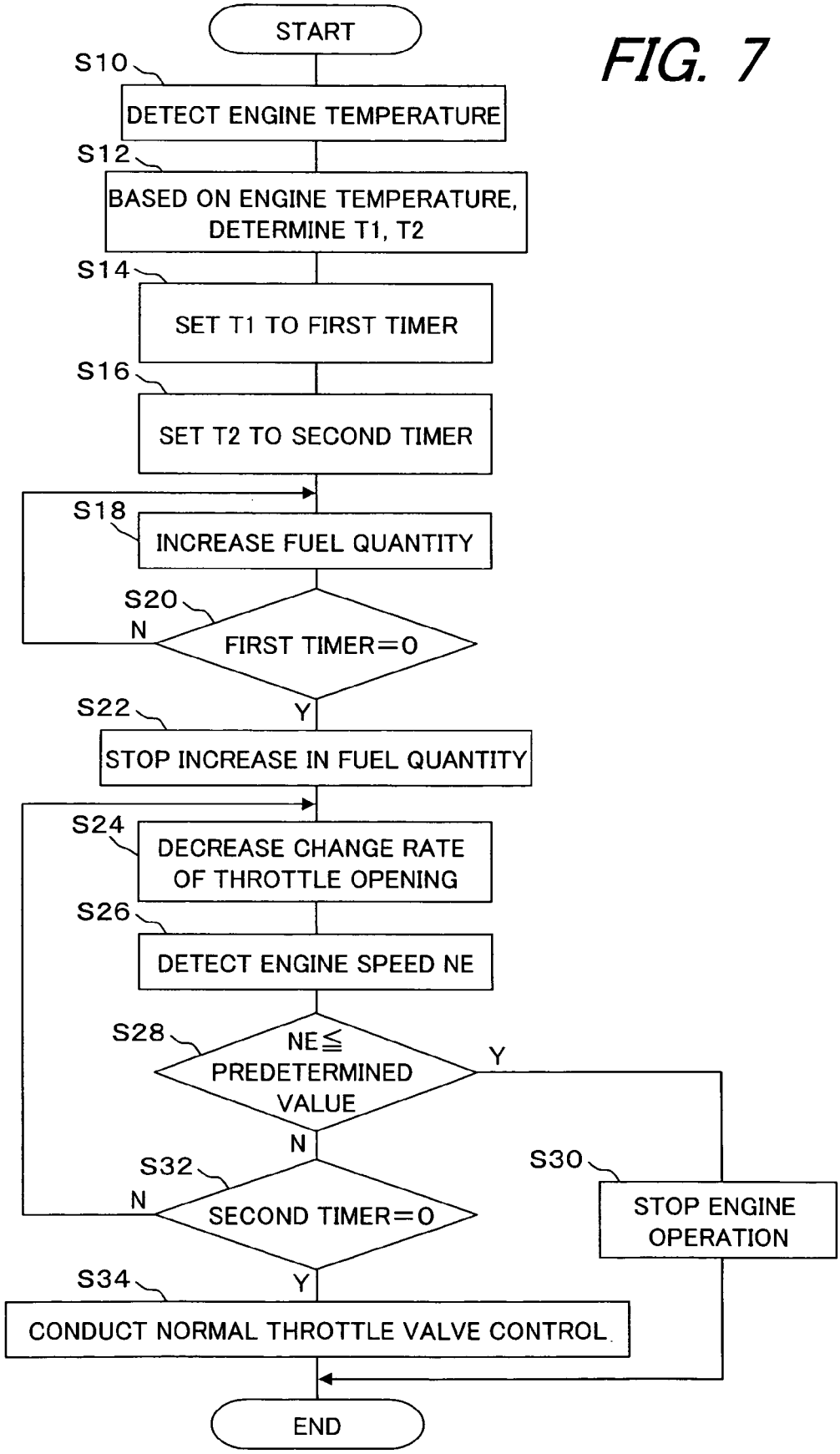
FIG. 7 is a flowchart showing the processing of controlling the operation of a motor of the throttle valve etc., at engine starting shown in FIG. 1.

FIG. 7 is a flowchart showing the processing of this operation of the motor 70 executed by the ECU 114. The illustrated program is executed only once at engine starting. The throttle valve 60 and choke valve 62 are positioned as shown in FIGS. 6 and 4C before the engine 10 is started, specifically the throttle valve 60 is at the over-fully-opened position due to the urging force by the return spring 84 and the choke valve 62 is at the fully-closed position by the return spring 102.

When the recoil starter 44 is manipulated by the operator and the power coil 40 starts generating power to activate the ECU 114, the processing begins.

In S10, based on the output of the temperature sensor 28, the temperature of the engine 10 is detected.

In S12, based on the detected temperature, a first warm-up time period T1 and a second warm-up time period T2 for warming up the engine 10 are determined. The first warm-up time period T1 means a time period since engine starting until the engine speed NE becomes stable and the second warm-up time period T2 means a time period until the engine operating condition becomes stable (i.e., completely-warmed condition) that can prevent a stall even when, for example, the throttle valve 60 is abruptly opened or closed.

Figure 8:
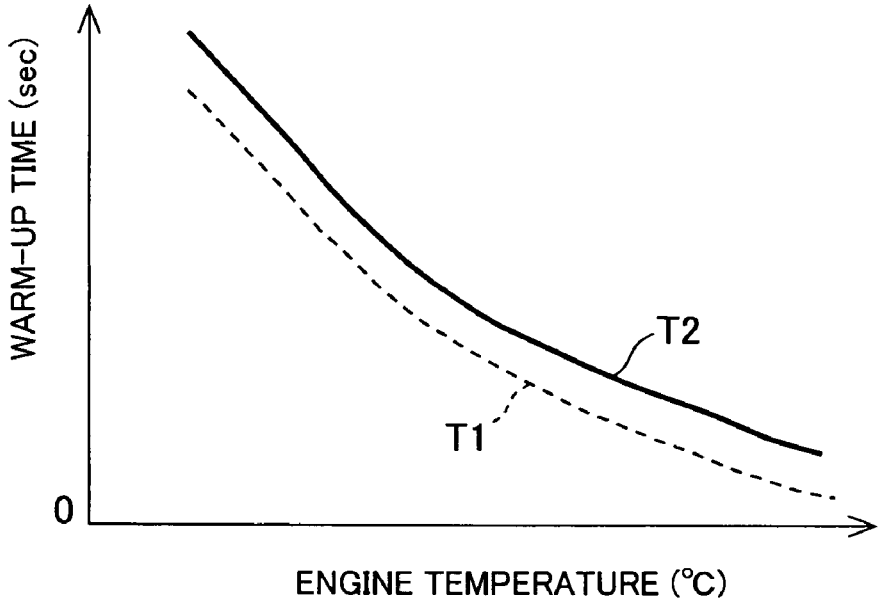
FIG. 8 is a graph showing property of table of a first and second warm-up time periods with respect to engine temperature, which is used in the processing of FIG. 7.

Specifically, as shown in FIG. 8, the first and second warm-up time periods T1, T2 are determined or calculated by retrieving a value from mapped values (that were experimentally obtained and stored in the ROM beforehand) using the temperature of the engine 10. In FIG. 8, the first warm-up time period T1 is indicated by a dashed line and the second warm-up time period T2 by a solid line.

As can be seen in FIG. 8, the second warm-up time period T2 is set to be longer than the first warm-up time period T1. Also, the first and second warm-up time periods T1, T2 decrease with increasing temperature of the engine 10. This is because, when the temperature of the engine 10 is relatively low (i.e., ambient temperature is relatively low and the engine 10 is cold started), it takes a long time to complete warm-up and, when the engine temperature is high (i.e., ambient temperature is relatively high or the engine 10 is hot-started), warm-up is completed in a short time.

The program proceeds to S14, in which the determined first warm-up time period T1 is set to a first timer (down counter; timer) and to S16, in which the second warm-up time period T2 is set to a second timer (down counter; timer). Thus the elapsed time period since starting of the engine 10 is measured using the first and second timers.

In S18, the warm-up operation is conducted by increasing a fuel quantity to be supplied to the engine 10. Specifically, the operation of the motor 70 is controlled so as to move (open and close) the throttle valve 60 between the over-fully-opened position and the fully-opened position. The throttle valve 60 is thus moved to open and close the choke valve 62 between the fully-closed position and the fully-opened position, as shown in FIGS. 4B, 4C. As a result, the fuel quantity is increased and the air-fuel mixture in the air intake passage 50 is made rich for conducting the warm-up operation, thereby improving the starting performance of the engine 10.

In S20, it is determined whether a value of the first timer has reached zero. When the result is No, the program returns to SI 8 and the above-mentioned warm-up operation with increased fuel quantity is kept continuing. In other words, the fuel quantity to be supplied to the engine 10 is continued to be increased until the elapsed time since the engine starting exceeds the first warm-up time period T1.

When the result in S20 is Yes, the program proceeds to S22, in which the fuel quantity increase is stopped, i.e., the warm-up operation with increased fuel quantity is terminated. Specifically, the operation of the motor 70 is controlled so that the throttle valve 60 being moved between the over-fully-opened position and the fully-opened position is moved to the fully-opened position. As a result, as shown in FIG. 4B, the choke valve 62 is held at the fully-opened position and the fuel quantity increase by the choke valve 62 is stopped.

In S24, the motor 70 is controlled so that the change rate of the throttle opening (i.e., change amount of the throttle opening per a unit time) of the throttle valve 60 is decreased and, under this condition, the throttle valve 60 is moved between the fully-closed position and the fully-opened position (precisely, moved to the desired opening so as to maintain the desired engine speed NED inputted through the switch 110).

The decrease in the change rate of the throttle opening is made by decreasing the rotational speed of the motor 70 to, say, 100 pps when the normal speed is 300 pps.

Figure 9:
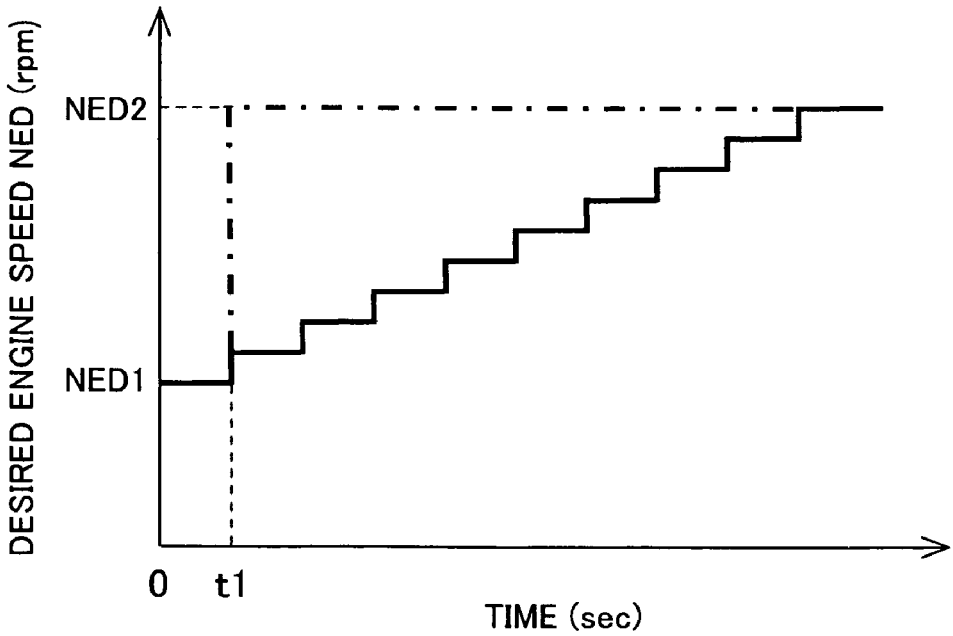
FIG. 9 is a time chart showing variation in desired engine speed with respect to outputs of an engine speed setting switch, which is similarly used in the processing of FIG. 7.

The decrease in the change rate of the throttle opening is also made by gradually varying the desired engine speed NED. This is further explained with reference to FIG. 9.

For instance, when the engine speed setting switch 110 is manipulated at a time point t1 to vary the desired engine speed from a first desired engine speed NED1 to a second desired engine speed NED2, the desired engine speed NED in the ECU 114 is not immediately changed to the second desired engine speed NED 2 (indicated by a dashed-dotted line in FIG. 9) but gradually changed (increased) from the first desired engine speed NED1 to the second desired engine speed NED2. Since it is configured such that the desired engine speed NED changes in stages, the throttle opening of the throttle valve 60 is gradually increased along therewith, thereby decreasing the change rate of the throttle opening. Although the increasing desired engine speed NED is exemplified in the foregoing, the desired engine speed NED can also be gradually decreased.

The program proceeds to S26, in which the engine speed NE is detected and to S28, in which it is determined whether the detected engine speed NE is equal to or lower than a predetermined value (e.g., 1300 rpm). When the result in S28 is Yes, i.e., if the engine speed NE does not reach the predetermined value before the time since engine starting exceeds the second warm-up time period T2 after it exceeded the first warm-up time period T1, it is assumed that a trouble has arose in the engine 10. Therefore, in S30, the operation of the engine 10 is stopped by terminating ignition and then the program is terminated.

When the result in S28 is No, the program proceeds to S32, in which it is determined whether a value of the second timer has reached zero. When the result in S32 is No, the program returns to S24 and the foregoing processing is repeated. Thus the operation of the motor 70 is controlled so that the change rate of the throttle opening of the throttle valve 60 is limited within a range until the time since engine starting exceeds the second warm-up time period T2 after it exceeded the first warm-up time period T1.

When the result in S32 is Yes, i.e., when the engine 10 is in the completely-warmed condition and the warm-up operation has been finished, the program proceeds to S34, in which the throttle valve 60 is normally operated. Specifically, the rotational speed of the motor 70 is made to the normal value (e.g., 300 pps), while the desired engine speed NED is made equal to the output of the switch 110, and under this condition, the operation of the motor 70 is controlled so that the throttle valve 60 is moved between the fully-closed position and the fully-opened position (precisely, moved to the desired opening so as to maintain the desired engine speed NED).

Next, the explanation will be made on the opening and closing operation of the throttle valve 60 and choke valve 62 when the engine 10 is stopped.

Figure 10:
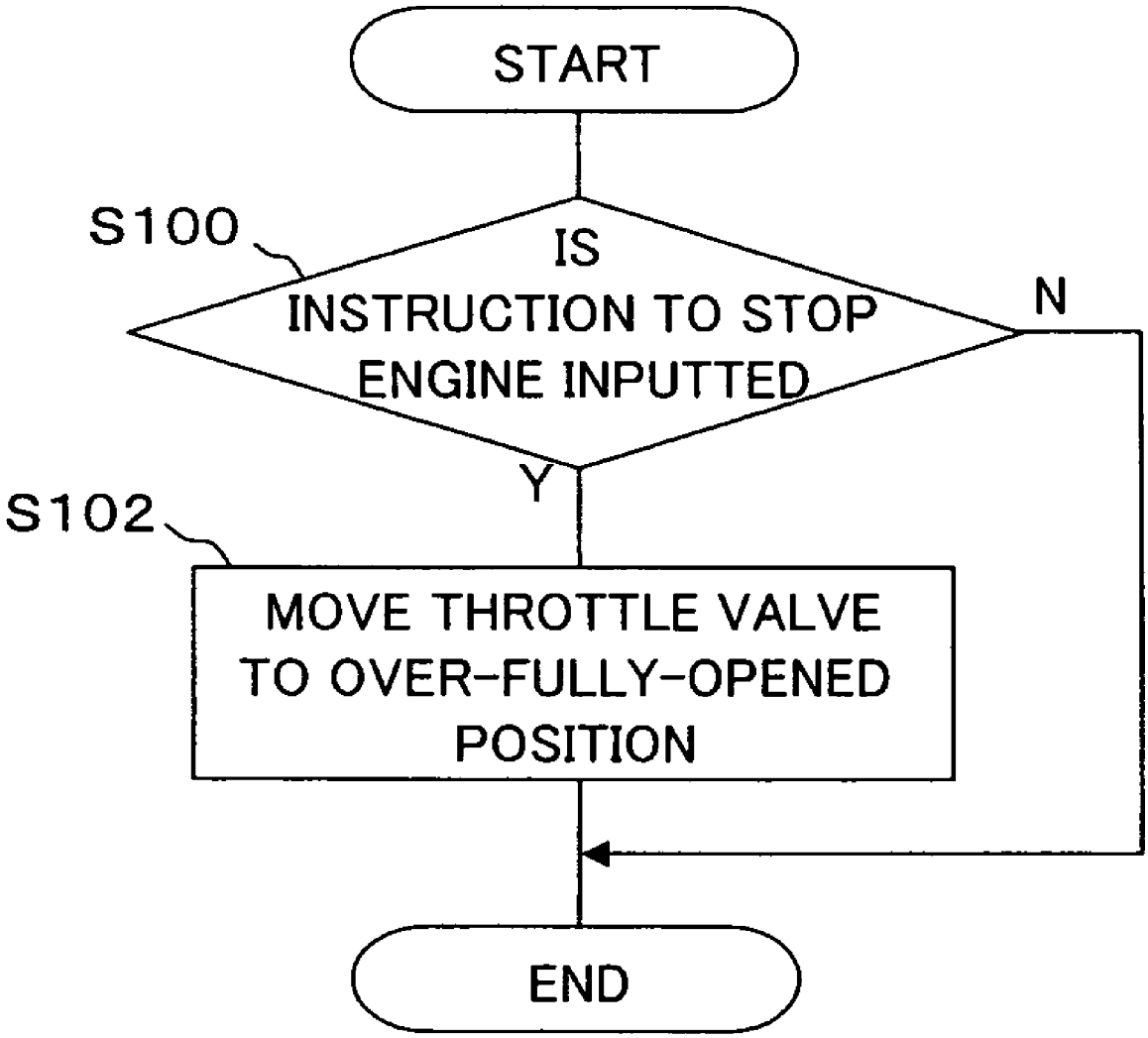
FIG. 10 is a flowchart showing the processing of controlling the operation of the motor of the throttle valve when the engine is stopped.

FIG. 10 is a flowchart showing the processing of this operation of the motor 70 executed by the ECU 114. The illustrated program is executed at predetermined interval, e.g., 100 milliseconds.

In S100, it is determined whether an instruction to stop the engine 10 is inputted, specifically, the engine stop switch 112 outputs an ON signal by manipulation by the operator. When the result is No, the remaining steps are skipped and when the result is Yes, the program proceeds to S102, in which the operation of the motor 70 is controlled so that the throttle valve 60 is moved (opened) to the over-fully-opened position. The throttle valve 60 is thus moved to close the choke valve 62 to the fully-closed position, as shown in FIG. 4C, for the next engine start.

As described in the foregoing, the first embodiment is configured such that the fuel quantity to be supplied to the engine 10 is increased until the time since engine starting exceeds the first warm-up time period T1. Since the first warm-up time period T1 is defined as a time period until the engine speed NE becomes stable and the second warm-up time period T2 as a time period until the completely-warmed condition has been established, the increase in fuel quantity can be terminated in the first warm-up time period T1 that is shorter than the second warm-up time period T2 in which the completely-warmed condition is established. With this, the warm-up operation conducted with increased fuel quantity can be completed in a short period of time, thereby enabling to improve the rate of fuel consumption and emission performance. Further, it is configured such that the operation of the motor 70 is controlled so that the change rate of the throttle opening of the throttle valve 60 is limited within a range until the time since engine starting exceeds the second warm-up time period T2 after it exceeded the first warm-up time period T1, but does not elapse over the second warm-up time period T2. With this, the throttle valve 60 is not abruptly opened and closed until the completely-warmed condition has been established and sharp change in the air-fuel mixture can be avoided, thereby enabling to reliably prevent a stall of the engine 10 from occurring. Further, it becomes possible to mitigate contamination of the combustion chamber 16, ignition plug, lubricant oil and the like due to increase in the excessive fuel quantity.

A control apparatus for a general-purpose engine according to a second embodiment of this invention will be explained.

Figure 11:
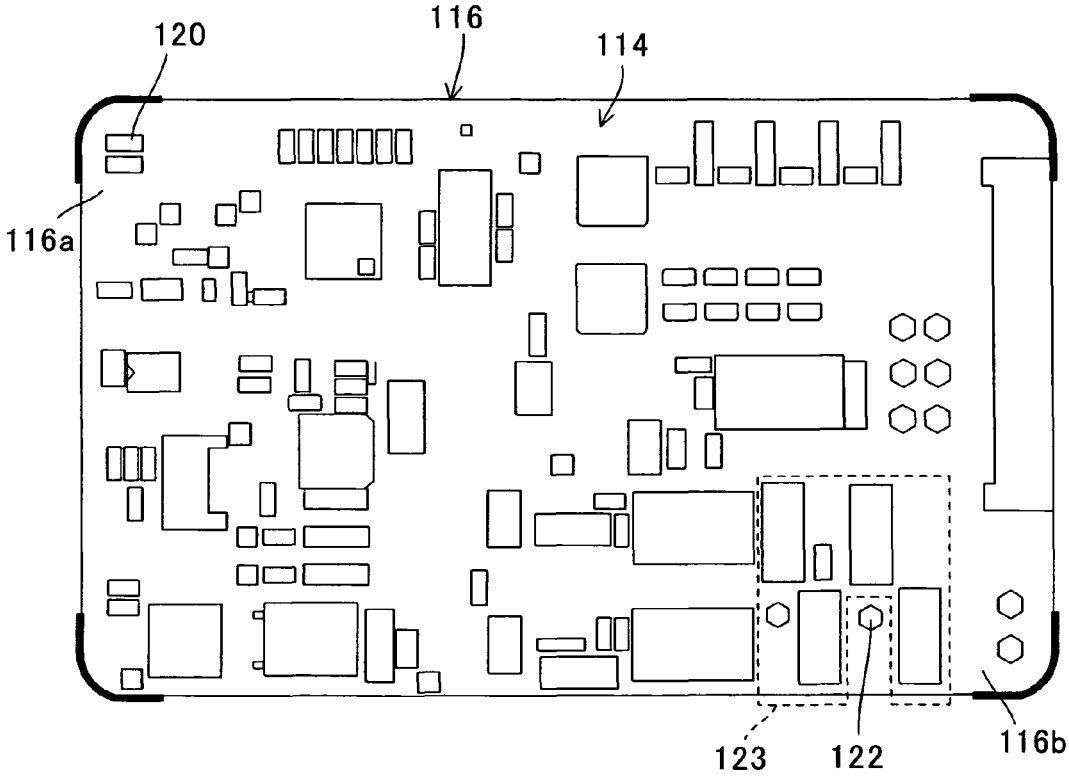
FIG. 11 is a plan view of an electronic circuit board on which an ECU shown in FIG. 1 is mounted, in a control apparatus for a general-purpose engine according to a second embodiment of this invention.

FIG. 11 is a plan view of an electronic circuit board on which the ECU 114 is mounted, in the control apparatus for the general-purpose engine according to the second embodiment. Constituent elements corresponding to those of the first embodiment are assigned by the same reference symbols as those in the first embodiment and will not be explained.

The explanation will be made with focus on points of difference from the first embodiment. In the second embodiment, as shown in FIG. 11, the ECU 114 is mounted on an electronic circuit board 116.

The board 116 is mounted with, in addition to the ECU 114, an ambient temperature sensor 120 for detecting ambient temperature ta and an engine temperature sensor (engine temperature detector) 122 for detecting temperature tb of the engine 10 (both of which are indicated by imaginary lines in FIG. 1). The sensors 120, 122 are constituted as thermistor temperature sensors utilizing electric resistance.

The ambient temperature sensor 120 is installed at an end 116*a* (the upper left portion in FIG. 11) of the board 116, specifically at a location where the temperature is less likely to change between the situations when the engine is operating and when it is not operating. In other words, the sensor 120 is configured to be not affected by the operating condition of the engine 10 and hence, is likely to be proportional to the ambient temperature.

The engine temperature sensor 122 is installed at another end 116*b* (the lower right portion in FIG. 11) opposite from the end 116*a* of the board 116, specifically at a position apart from the ambient temperature sensor 120 by a predetermined distance. A vicinity of the sensor 122 is installed with a circuit (e.g., a power circuit (a group of electronic components surrounded by a dashed line in FIG. 11)) 123 that generates heat when being supplied with operating current (i.e., when the engine 10 is in operation).

Owing to this configuration, the surrounding temperature of the engine temperature sensor 122 gradually increases to predetermined temperature upon engine starting and gradually decreases when the engine 10 is stopped. The actual engine temperature changes in response to the operating condition of the engine 10, similarly to the surrounding temperature of the sensor 122. Specifically, since the surrounding temperature of the sensor 122 and the temperature of the engine 10 are in the proportional relationship, the sensor 122 produces an output or signal indicative of the temperature proportional to the engine temperature. Note that the temperature sensor 28 is removed in the second embodiment.

The outputs of the sensors 120, 122 are sent to the ECU 114.

Figure 12:
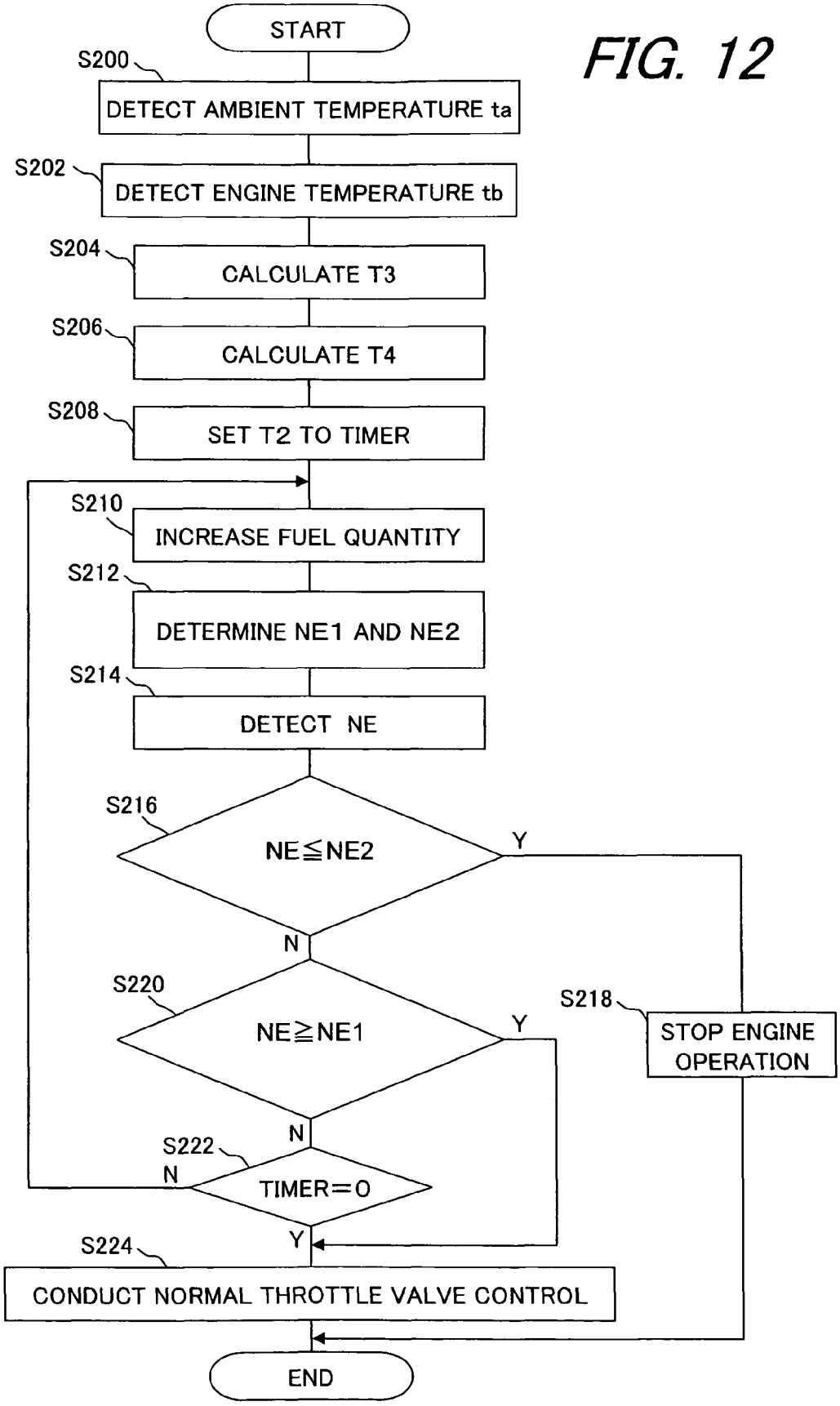
FIG. 12 is a flowchart showing the processing of controlling the operation of the motor of the throttle valve etc., at engine starting shown in FIG. 1.

FIG. 12 is a flowchart similar to FIG. 7, but showing the processing of controlling the operation of the motor of the throttle valve 60 etc., at engine starting executed by the ECU 114.

In S200, the ambient temperature ta is detected based on the output of the ambient temperature sensor 120 and in S202, the engine temperature tb is detected based on the output of the engine temperature sensor 122.

In S204, based on the detected ambient temperature ta and the engine temperature tb, an engine stoppage time T3, i.e., an elapsed time period since the last engine stop to this starting is calculated (assumed). Specifically, as shown in FIG. 13, the stoppage time T3 is calculated by retrieving a value from mapped values (experimentally obtained and stored in the ROM beforehand) using a difference obtained by subtracting the ambient temperature ta from the engine temperature tb.

Figure 13:
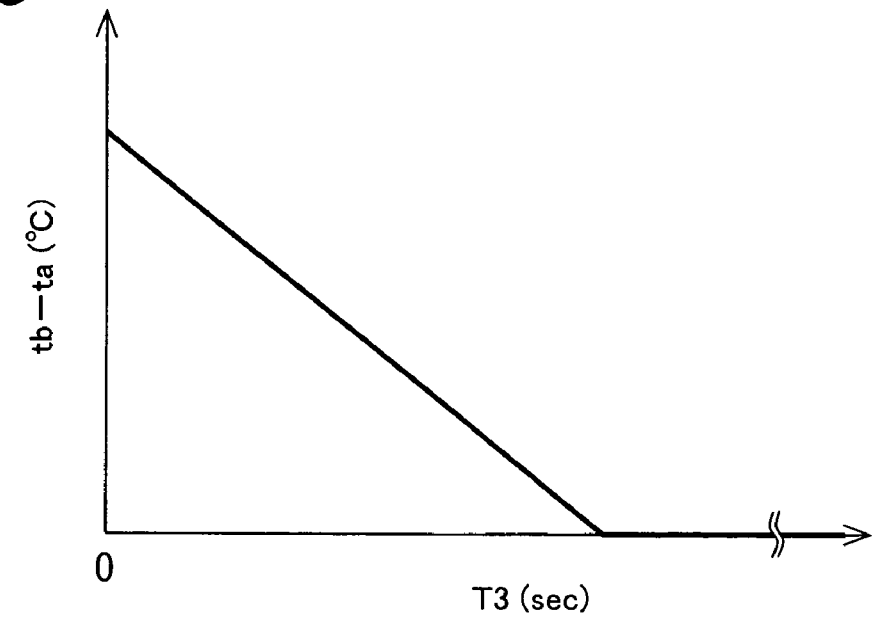
FIG. 13 is a graph showing property of table of a stoppage time period with respect to a difference between engine temperature and ambient temperature to be used in the processing of FIG. 12.

As can be seen in FIG. 13, when the difference between the temperatures tb, ta is large, it is assumed that the engine 10 will be restarted within in a short period since the last stop (i.e., hot-started), so that the stoppage time period T3 is set to be short. On the other hand, when the difference is small, it is assumed that the engine 10 will be restarted after elapse of a certain time period since the last stop (cold starting) and hence, the stoppage time period T3 becomes long.

In S206, based on the calculated stoppage time period T3, a time period during which the engine 10 is being warmed up, i.e., a warm-up time period T4 is determined. The warm-up time period T4 means a time period during which the engine 10 is warmed up so that the engine 10 does not stall even if, for example, the throttle valve 60 is abruptly opened or closed, (i.e., the completely-warmed condition). Explaining the processing of determining the warm-up time period T4, in this embodiment, mapped values as to the relationship between the stoppage time period T3 and warm-up time period T4 are experimentally prepared beforehand as shown in FIG. 14 and the warm-up time period T4 is determined or calculated by retrieving the mapped values using the calculated stoppage time T3.

Figure 14:
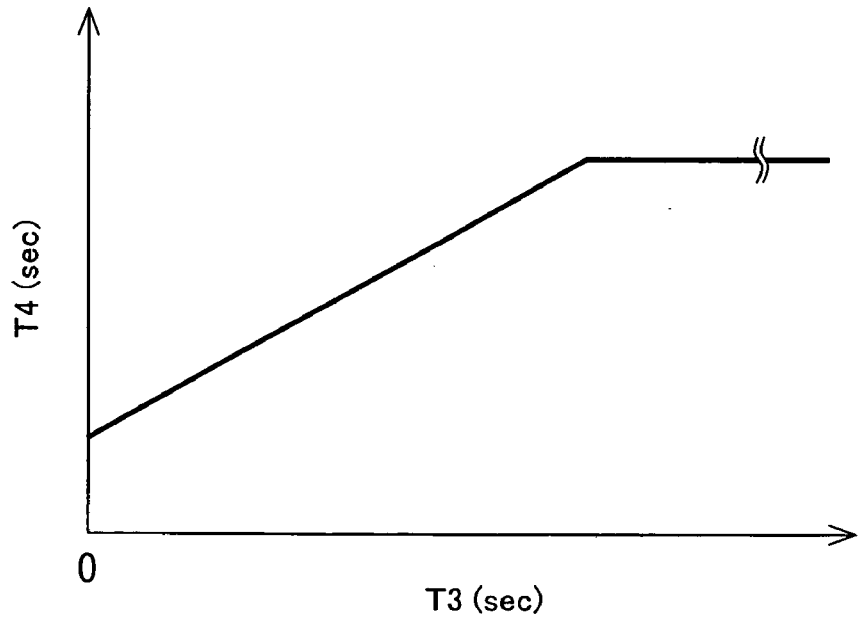
FIG. 14 is a graph showing property of table of a warm-up time period with respect to the stoppage time to be used in the processing of FIG. 12.

As shown in FIG. 14, the warm-up time period T4 is set to increase as the stoppage time period T3 becomes longer. This is because, when the stoppage time period T3 is relatively short (hot start), warm-up is completed in a short time and, when the stoppage time period T3 is relatively long (cold start), it takes a long time to complete warm-up. Thus, based on the ambient temperature ta and engine temperature tb, the stoppage time period T3 is calculated and, based on the calculated stoppage time period T3, the warm-up time period T4 during which the engine 10 should be warmed up is determined.

The program proceeds to S208, in which the warm-up time period T4 is set to a timer (down counter). Specifically, the time since starting of the engine 10 is measured using the timer. Then, in S210, the warm-up operation is conducted by increasing the fuel quantity to be supplied to the engine 10.

In S212, based on the output (desired engine speed NED) of the engine speed setting switch 110, an upper limit engine speed (first predetermined value) NE1 and a lower limit engine speed (second predetermined value) NE2 in the warm-up operation are determined. When the engine speed NE has reached the upper limit engine speed NE1, it is discriminated that the engine 10 is in the completely-warmed condition. The upper limit engine speed NE1 is, for example, a value obtained by adding 300 rpm to the desired engine speed NED. When the engine speed NE does not reach the lower limit engine speed NE2, it is discriminated that a trouble has arose in the engine 10. The lower limit engine speed NE2 is, for example, a value obtained by subtracting 300 rpm from the desired engine speed NED.

In S214, the engine speed NE is detected and in S216, it is determined whether the engine speed NE is equal to or lower than the lower limit engine speed NE2. When the result in S216 is Yes, i.e., when the engine speed NE does not reach the lower limit engine speed NE2 before the warm-up time period T4 elapses since engine starting, it is assumed that a trouble has arose in the engine 10. Therefore, in S218, the operation of the engine 10 is stopped and then the program ends.

When the result in S216 is No, the program proceeds to S220, in which it is determined whether the engine speed NE is equal to or greater than the upper limit engine speed NE1. When the result in S220 is No, the program proceeds to S222, in which it is determined whether a value of the timer has reached zero. When the result in S222 is No, the program returns to S210, in which the warm-up operation with increased fuel quantity is continued. Thus, the fuel quantity to be supplied to the engine 10 is kept increasing until the value of the timer has reached zero, i.e., until the warm-up time period T4 elapses.

When the result in S222 is Yes, i.e., the warm-up time period T4 elapses since engine starting, the program proceeds to S224, in which the throttle valve 60 is normally controlled. Specifically, the operation of the motor 70 is controlled so as to move the throttle valve 60 between the fully-closed position and the fully-opened position (i.e., move the throttle valve 60 to the desired opening so as to maintain the desired engine speed NED). Since the throttle valve 60 is thus moved, the choke valve 62 is held at the fully-opened position and the increase in fuel quantity (warm-up operation) by the choke valve 62 is stopped.

When the result in S220 is Yes, since it means that the engine 10 is in the completely-warmed condition and the further warming is no longer required, the program skips S222 and proceeds to S224, in which the warm-up operation is stopped (discontinued). Thus, when the engine speed NE becomes equal to or greater than the upper limit engine speed NE1 before the warm-up time period T4 has elapsed, the increase in fuel quantity (warm-up operation) is terminated.

As described in the foregoing, since the second embodiment is thus configured such that the warm-up time period T4 is determined based not only on the ambient temperature ta but on the engine temperature tb, the warm-up time period T4 can be determined to be appropriate for the engine 10. With this, the warm-up operation conducted with increased fuel quantity can be terminated within the appropriate warm-up time period T4, thereby enabling to improve the rate of fuel consumption and emission performance. Further, deficiency in the warm-up time period can be avoided, thereby preventing a stall from occurring.

The remaining configuration and effects are the same as those in the first embodiment and will not be explained.

A control apparatus for a general-purpose engine according to a third embodiment of this invention will be explained.

The explanation will be made with focus on points of difference from the first embodiment. In the third embodiment, as shown in FIG. 1 by an imaginary line, the engine 10 is equipped at an appropriate portion with a second ambient temperature sensor 124 that produces an output or signal indicative of ambient temperature, i.e., temperature of ambient air (intake air) sucked in the engine 10 and sends it to the ECU 114.

Figure 15:
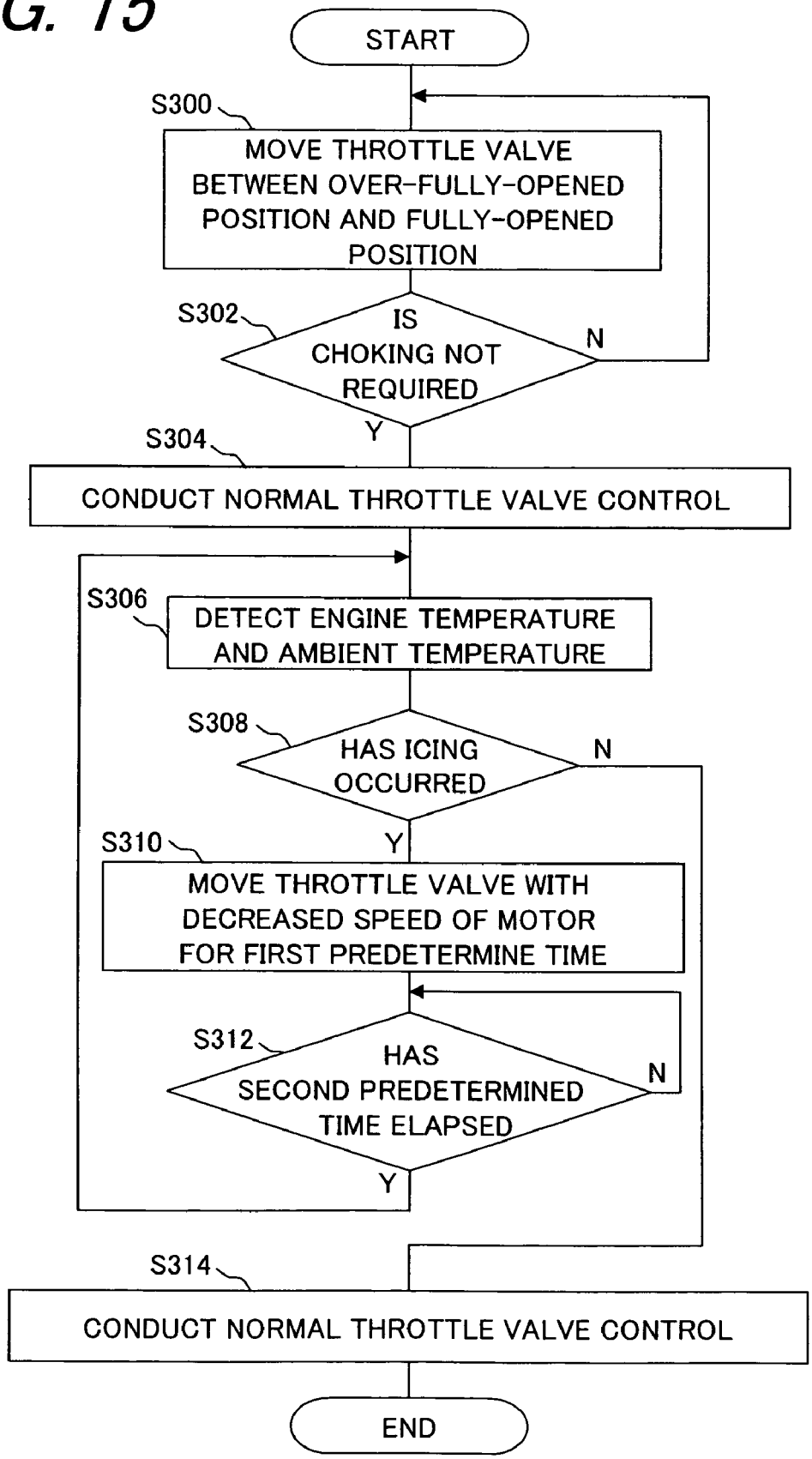
FIG. 15 is a flowchart showing the processing of controlling the operation of the motor of the throttle valve etc., at engine starting of a control apparatus for a general-purpose engine according to a third embodiment of this invention.

FIG. 15 is a flowchart similar to FIG. 7, but showing the processing of controlling the operation of the motor of the throttle valve 60 etc., at engine starting executed by the ECU 114.

In S300, the operation of the motor 70 is controlled so that the throttle valve 60 is moved (opened and closed) between the over-fully-opened position and the fully-opened position. As a result, the air-fuel mixture in the air intake passage 50 is made rich and the starting performance of the engine 10 is improved.

In S302, it is determined whether the choking is not required, i.e., whether the warm-up operation has been completed and the supply of enriched air-fuel mixture by the choke valve 62 should be terminated. The determination in S302 is made based on the engine speed NE and, when the engine speed NE exceeds a predetermined value (e.g., 3000 rpm) and becomes stable, it is discriminated that the choking is not required.

When the result in S302 is No, the program returns to S300 and when the result is Yes, the program proceeds to S304, in which the normal control of the throttle valve 60 is conducted to terminate the supply of rich air-fuel mixture. Specifically, the operation of the motor 70 is controlled so as to move the throttle valve 60 between the fully-closed position and the fully-opened position. Since the throttle valve 60 is thus moved, the choke valve 62 is held at the fully-opened position, thereby terminating supply of the rich air-fuel mixture.

The program proceeds to S306, in which the temperature of the engine 10 and the ambient temperature are detected based on the outputs of the temperature sensor 28 and the second ambient temperature sensor 124 and to S308, in which, based on the detected engine temperature and ambient temperature, it is determined whether icing has occurred (precisely, icing likely occurs) at the throttle valve 60. In S308, specifically, when at least one of the engine temperature and the ambient temperature is equal to or lower than predetermined temperature (e.g., 5° C.), it is discriminated that icing has occurred at the throttle valve 60, while, when exceeding the predetermined temperature, it is discriminated that no icing occurs.

When the result in S308 is Yes, i.e., it is likely that icing has occurred at the throttle valve 60 and the throttle valve 60 is locked due to the icing, the program proceeds to S310, in which the operation of the motor 70 is controlled so that a deicing operation mode for deicing the stuck ice is continuously conducted during a first predetermined time period (e.g., 10 sec), specifically, during the period, the throttle valve 60 is moved with the decreased rotational speed of the motor 70.

The deicing operation mode will be explained in detail. The rotational speed of the motor 70 is decreased, for instance, to 100 pps (i.e., one-third of the normal speed 300 pps or thereabout). With this, torque of the motor 70 can be increased. The throttle valve 60 is opened and closed with the increased torque of the motor 70, thereby deicing the ice stuck around the throttle valve 60.

In S312, it is determined whether a second predetermined time period (predetermined time; e.g., 30 sec) has elapsed since starting of the deicing operation mode and, when the result is No, the determination of S312 is repeated. When the result is Yes, the program returns to S306 for determining as to whether the icing occurred through the processing of S306 and S308. Thus, until it is discriminated that the engine temperature and ambient temperature exceed the predetermined temperature and deicing is completed (precisely, there is no possibility of icing), the icing determination is repeated at every second predetermined time period. In other words, the throttle valve 60 is moved (opened and closed) with the increased torque of the motor 70 insofar as there is icing possibility.

When the result in S308 is No, i.e., it is discriminated that deicing is completed, the program proceeds to S314, in which the above-mentioned normal control of the throttle valve 60 is conducted. Specifically, the speed of the motor 70 is made to the normal speed (e.g., 300 pps) and the operation of the motor 70 is controlled so that the throttle valve 60 is moved between the fully-closed position and the fully-opened position.

As described in the foregoing, the third embodiment is configured such that torque of the motor 70 is increased by decreasing the rotational speed of the motor 70 and with the increased torque, the throttle valve 60 is moved (opened and closed). With this, icing at the throttle valve 60 generated in the low-temperature operation can be deiced by opening and closing the throttle valve 60, so the throttle valve 60 can avoid being locked due to icing, thereby preventing a stall from occurring. Also, since a cooling passage or other equipment used in a technique taught by Japanese Laid-Open Patent Application No. Hei 6(1994)-17718 is not required, it becomes possible to avoid complexity in structure or growth in size and it is advantageous in terms of cost.

The remaining configuration and effects are the same as those in the first embodiment and will not be explained.

As stated above, in the first embodiment, it is configured to have an apparatus for controlling a general-purpose internal combustion engine (10) having a throttle valve (60) installed in an air intake passage (50) connected to a combustion chamber (16), air sucked in flowing through the air intake passage and mixing with fuel to generate an air-fuel mixture that enters the combustion chamber of a cylinder (12) and ignited to drive a piston (14) to rotate a crankshaft (30) to be connected to a load, comprising: an actuator (electric motor 70) for opening/closing the throttle valve; a temperature detector (temperature sensor 28, ECU 114, S10) that detects a temperature of the engine; a warm-up time period determiner (ECU 114, S12) that determines a first warm-up time period (T1) during which the engine is to be warmed up and a second warm-up time period (T2) which is longer than the first warm-up time period, based on the detected engine temperature; a timer (first timer, second timer, ECU 114, S14, S16) that measures an elapsed time period since starting of the engine; a fuel quantity increaser (ECU 114, S18, S20) that increases a fuel quantity to be supplied to the engine until the measured time exceeds the first warm-up time period; and a controller (ECU 114, S24, S32) that controls operation of the actuator such that a change rate of throttle opening of the throttle valve is limited within a range until the measured time period exceeds the second warm-up time period after the measured time period exceeded the first warm-up time period. With this, the warm-up operation conducted with increased fuel quantity can be completed in a short period of time, thereby enabling to improve the rate of fuel consumption and emission performance. Further, the throttle valve 60 is not abruptly opened and closed until the completely-warmed condition has been established and sharp change in the air-fuel mixture can be avoided, thereby enabling to reliably prevent a stall of the engine 10 from occurring.

The apparatus includes an engine speed detector (ECU 114, S26) that detects a speed of the engine; and an operation stopper (ECU 114, S28, S30) that stops operation of the engine when the detected engine speed does not reach a predetermined value until the measured time period exceeds the second warm-up time period after the measured time period exceeded the first warm-up time period. With this, when it is assumed that, for example, a trouble has arose in the engine 10 and the engine speed NE does not increase, the operation of the engine 10 can be surely stopped.

In the apparatus, the warm-up time period determiner determines the first warm-up time period and the second warm-up time period to decrease with increasing temperature of the engine. With this, it becomes possible to appropriately set the first and second warm-up times T1, T2 depending on the condition of the engine 10.

In the third embodiment, the apparatus further includes an ambient temperature detector (second ambient temperature sensor 124, ECU 114, S306) that detects an ambient temperature; and an icing determiner (ECU 114, S308) that determines as to whether icing occurs at the throttle valve based on one of the detected engine temperature and the detected ambient temperature, wherein the actuator is an electric motor (70) and the controller controls the operation of the motor such that the throttle valve is moved with decreased speed of the motor when it is determined that icing has occurred (ECU 114, S310). With this, icing at the throttle valve 60 generated in the low-temperature operation can be deiced by opening and closing the throttle valve 60, so the throttle valve 60 can avoid being locked due to icing, thereby preventing a stall from occurring.

In the apparatus, the icing determiner determines as to whether the icing occurs at every predetermined time until it is discriminated that deicing has been completed (S308, S312). Thus, the icing determination is repeated at every predetermined time until it is discriminated that deicing is completed, in other words, the throttle valve 60 is moved (opened and closed) with the increased torque of the motor 70 insofar as there is icing possibility. With this, it becomes possible to accelerate the deicing operation by opening and closing the throttle valve 60.

In the second embodiment, it is configured to have an apparatus for controlling a general-purpose internal combustion engine (10) having a throttle valve (60) installed in an air intake passage (50) connected to a combustion chamber (16), air sucked in flowing through the air intake passage and mixing with fuel to generate an air-fuel mixture that enters the combustion chamber of a cylinder (12) and ignited to drive a piston (14) to rotate a crankshaft (30) to be connected to a load, comprising: a temperature detector (engine temperature sensor 122, S202) that detects a temperature of the engine; an ambient temperature detector (ambient temperature sensor 124, S200) that detects an ambient temperature; a warm-up time period determiner (ECU 114, S206) that determines a warm-up time period (T4) based on the detected engine temperature tb and the detected ambient temperature ta; a timer that measures an elapsed time period since starting of the engine; and a fuel quantity increaser (ECU 114, S208, S210, S222) that increases a fuel quantity to be supplied to the engine until the measured time period exceeds the warm-up time period. With this, the warm-up operation conducted with increased fuel quantity can be terminated within the appropriate warm-up time period T4, thereby enabling to improve the rate of fuel consumption and emission performance. Further, deficiency in the warm-up time period can be avoided, thereby preventing a stall from occurring.

The apparatus further includes an engine speed detector (ECU 114, S214) that detects speed of the engine, wherein the fuel quantity increaser stops increasing the fuel quantity when the detected engine speed NE becomes equal to or greater than a first predetermined value (upper limit engine speed NE1) before the measured time period exceeds the warm-up time period. Since the upper limit engine speed NE1 is set to be a value enabling to determine that the engine 10 is in the completely-warmed condition, the warm-up operation conducted with increased fuel quantity can be completed in a short period of time, thereby enabling to further improve the rate of fuel consumption and emission performance. Even when the warm-up operation is completed in a short time, since the engine 10 is still in the completely-warmed condition, a stall can be prevented.

The apparatus further includes an operation stopper (ECU 114, S216, S218) that stops operation of the engine when the detected engine speed NE does not reach a second predetermined value (lower limit engine speed NE2) before the measured time period exceeds the warm-up time period. With this, when it is assumed that, for example, a trouble has arose in the engine 10 and the engine speed NE does not increase, the operation of the engine 10 can be surely stopped.

In the apparatus, the warm-up time period determiner calculates a stoppage time period (T3) of the engine based on the detected engine temperature and the detected ambient temperature and determines the warm-up time period based on the calculated stoppage time period (S204, S206). With this, since the operating condition of the engine 10 at starting (whether it is hot start or cold start) is assumable using the calculated warm-up time T3, the warm-up time T4 can be appropriately determined based on the assumed operating condition.

In the apparatus the temperature detector is installed at a location near a circuit (123) that is heated when the engine is in operation and the ambient temperature detector is installed at a location where change in temperature is relatively small between when the engine is operating and when it is not operating. With this, it becomes possible to detect the ambient temperature ta and engine temperature tb with compact structure.

The apparatus further includes an electric motor (70) that drives the throttle valve; an icing determiner (ECU 114, S308) determines as to whether icing occurs at the throttle valve based on at least one of the detected engine temperature and the detected ambient temperature; and a motor controller (ECU 114, S310) that controls operation of the motor such that the throttle valve is moved with decreased speed of the motor when it is determined that icing has occurred. With this, icing at the throttle valve 60 can be deiced, so the throttle valve 60 can avoid being locked due to icing, thereby preventing a stall from occurring more reliably.

In the apparatus, the icing determiner determines as to whether the icing occurs once per predetermined time until it is discriminated that deicing has been completed (S308, S312). With this, it becomes possible to accelerate the deicing operation further by opening and closing the throttle valve 60.

It should be noted that, in the first embodiment, although the change rate of the throttle opening of the throttle valve 60 is decreased by decreasing the speed of the motor 70 and gradually varying the desired engine speed NED, the change rate can be decreased solely by doing either one.

It should also be noted that, in the third embodiment, although the icing determination is made based on the engine temperature and ambient temperature, in addition thereto, the determination can be made based on humidity. For instance, when the humidity is at or above 70%, it can be discriminated that the icing has occurred.

It should also be noted that, although the deicing operation mode is configured so that the speed of the motor 70 is decreased to increase torque during the first predetermined time period, it should not limited thereto and the ice stuck around the throttle valve 60 can be deiced by opening and closing the throttle valve 60 several times (e.g., three times) with the increased torque of the motor 70.

It should also be noted that, although the ice is deiced by increasing torque of the motor 70 and opening and closing the throttle valve 60, in addition thereto, deicing can be conducted by opening and closing the choke valve 62 with the increased torque of the motor 70.

It should also be noted that, in the first to third embodiments, although the actuator (motor 70) for moving the throttle valve 60 and the like is exemplified as a stepper motor, it can instead be any of various other kinds of electric motor, electromagnetic solenoid, or hydraulic equipment that is operated by driving its pump by a motor.

It should further be noted that, although fuel is supplied by the carburetor 46, an injector (fuel injection valve) can be disposed at the intake port 24 for supplying fuel.

Japanese Patent Application Nos. 2008-115607, 2008-115608 and 2008-115609, all filed on Apr. 25, 2008, are incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling a general-purpose internal combustion engine having a throttle valve installed in an air intake passage connected to a combustion chamber, air sucked in flowing through the air intake passage and mixing with fuel to generate an air-fuel mixture that enters the combustion chamber of a cylinder and ignited to drive a piston to rotate a crankshaft to be connected to a load, comprising:

an actuator for opening/closing the throttle valve;

a temperature detector that detects a temperature of the engine;

a warm-up time period determiner that determines a first warm-up time period during which the engine is to be warmed up and a second warm-up time period which is longer than the first warm-up time period, based on the detected engine temperature;

a timer that measures an elapsed time period since starting of the engine;

a fuel quantity increaser that increases a fuel quantity to be supplied to the engine until the measured time exceeds the first warm-up time period; and a controller that controls operation of the actuator such that a change rate of throttle opening of the throttle valve is limited within a range until the measured time period exceeds the second warm-up time period after the measured time period exceeded the first warm-up time period.

2. The apparatus according to claim 1, further including:

an engine speed detector that detects a speed of the engine; and an operation stopper that stops operation of the engine when the detected engine speed does not reach a predetermined value until the measured time period exceeds the second warm-up time period after the measured time period exceeded the first warm-up time period.

3. The apparatus according to claim 1, wherein the warm-up time period determiner determines the first warm-up time period and the second warm-up time period to decrease with increasing temperature of the engine.

4. The apparatus according to claim 1, further including:

an ambient temperature detector that detects an ambient temperature; and an icing determiner that determines as to whether icing occurs at the throttle valve based on one of the detected engine temperature and the detected ambient temperature, wherein the actuator is an electric motor and the controller controls the operation of the motor such that the throttle valve is moved with decreased speed of the motor when it is determined that icing has occurred.

5. The apparatus according to claim 4, wherein the icing determiner determines as to whether the icing occurs at every predetermined time until it is discriminated that deicing has been completed.

6. An apparatus for controlling a general-purpose internal combustion engine having a throttle valve installed in an air intake passage connected to a combustion chamber, air sucked in flowing through the air intake passage and mixing with fuel to generate an air-fuel mixture that enters the combustion chamber of a cylinder and ignited to drive a piston to rotate a crankshaft to be connected to a load, comprising:

a temperature detector that detects a temperature of the engine;

an ambient temperature detector that detects an ambient temperature;

a warm-up time period determiner that determines a warm-up time period based on the detected engine temperature and the detected ambient temperature;

a timer that measures an elapsed time period since starting of the engine; and a fuel quantity increaser that increases a fuel quantity to be supplied to the engine until the measured time period exceeds the warm-up time period.

7. The apparatus according to claim 6, further including:

an engine speed detector that detects speed of the engine, wherein the fuel quantity increaser stops increasing the fuel quantity when the detected engine speed becomes equal to or greater than a first predetermined value before the measured time period exceeds the warm-up time period.

8. The apparatus according to claim 7, further including:

an operation stopper that stops operation of the engine when the detected engine speed does not reach a second predetermined value before the measured time period exceeds the warm-up time period.

9. The apparatus according to claim 6, wherein the warm-up time period determiner calculates a stoppage time period of the engine based on the detected engine temperature and the detected ambient temperature and determines the warm-up time period based on the calculated stoppage time period.

10. The apparatus according to claim 6, wherein the temperature detector is installed at a location near a circuit that is heated when the engine is in operation and the ambient temperature detector is installed at a location where change in temperature is relatively small between when the engine is operating and when it is not operating.

11. The apparatus according to claim 6, further including:

an electric motor that drives the throttle valve;

an icing determiner determines as to whether icing occurs at the throttle valve based on at least one of the detected engine temperature and the detected ambient temperature; and a motor controller that controls operation of the motor such that the throttle valve is moved with decreased speed of the motor when it is determined that icing has occurred.

12. The apparatus according to claim 11, wherein the icing determiner determines as to whether the icing occurs once per predetermined time until it is discriminated that deicing has been completed.

13. A method of controlling a general-purpose internal combustion engine having a throttle valve installed in an air intake passage connected to a combustion chamber, air sucked in flowing through the air intake passage and mixing with fuel to generate an air-fuel mixture that enters the combustion chamber of a cylinder and ignited to drive a piston to rotate a crankshaft to be connected to a load, and an actuator for opening/closing the throttle valve, comprising the steps of:

detecting a temperature of the engine;

determining a first warm-up time period during which the engine is to be warmed up and a second warm-up time period which is longer than the first warm-up time period, based on the detected engine temperature;

measuring an elapsed time period since starting of the engine;

increasing a fuel quantity to be supplied to the engine until the measured time exceeds the first warm-up time period; and controlling operation of the actuator such that a change rate of throttle opening of the throttle valve is limited within a range until the measured time period exceeds the second warm-up time period after the measured time period exceeded the first warm-up time period.

14. The method according to claim 13, further including the steps of:

detecting a speed of the engine; and stopping operation of the engine when the detected engine speed does not reach a predetermined value until the measured time period exceeds the second warm-up time period after the measured time period exceeded the first warm-up time period.

15. The method according to claim 13, wherein the step of warm-up time period determining determines the first warm-up time period and the second warm-up time period to decrease with increasing temperature of the engine.

16. The method according to claim 13, further including the steps of:

detecting an ambient temperature; and determining as to whether icing occurs at the throttle valve based on one of the detected engine temperature and the detected ambient temperature, wherein the actuator is an electric motor and the step of controlling controls the operation of the motor such that the throttle valve is moved with decreased speed of the motor when it is determined that icing has occurred.

17. The method according to claim 16, wherein the step of icing determining determines as to whether the icing occurs at every predetermined time until it is discriminated that deicing has been completed.

18. A method of controlling a general-purpose internal combustion engine having a throttle valve installed in an air intake passage connected to a combustion chamber, air sucked in flowing through the air intake passage and mixing with fuel to generate an air-fuel mixture that enters the combustion chamber of a cylinder and ignited to drive a piston to rotate a crankshaft to be connected to a load, comprising the steps of:

detecting a temperature of the engine;

detecting an ambient temperature;

determining a warm-up time period based on the detected engine temperature and the detected ambient temperature;

measuring an elapsed time period since starting of the engine; and increasing a fuel quantity to be supplied to the engine until the measured time period exceeds the warm-up time period.

19. The method according to claim 18, further including the steps of:

detecting speed of the engine, wherein the step of fuel quantity increasing stops increasing the fuel quantity when the detected engine speed becomes equal to or greater than a first predetermined value before the measured time period exceeds the warm-up time period.

20. The method according to claim 19, further including the step of:

stopping operation of the engine when the detected engine speed does not reach a second predetermined value before the measured time period exceeds the warm-up time period.

21. The method according to claim 18, wherein the step of warm-up time period determining calculates a stoppage time period of the engine based on the detected engine temperature and the detected ambient temperature and determines the warm-up time period based on the calculated stoppage time period.

22. The method according to claim 18, wherein the step of temperature detection is made at a location near a circuit that is heated when the engine is in operation and the step of ambient temperature detection is made at a location where change in temperature is relatively small between when the engine is operating and when it is not operating.

23. The method according to claim 18, including an electric motor that drives the throttle valve, and further including the steps of:

determining as to whether icing occurs at the throttle valve based on at least one of the detected engine temperature and the detected ambient temperature; and controlling operation of the motor such that the throttle valve is moved with decreased speed of the motor.

24. The method according to claim 23, wherein the step of icing determining determines as to whether the icing occurs once per predetermined time until it is discriminated that deicing has been completed.

* * * * *